US008191650B1

(12) United States Patent
Domingue

(10) Patent No.: US 8,191,650 B1
(45) Date of Patent: Jun. 5, 2012

(54) HYDRATING DRIVE SHOE

(76) Inventor: Clayton J. Domingue, Morse, LA (US)

( * ) Notice: Subject to any disclaimer, the term of this patent is extended or adjusted under 35 U.S.C. 154(b) by 133 days.

(21) Appl. No.: 12/432,369

(22) Filed: Apr. 29, 2009

Related U.S. Application Data

(60) Provisional application No. 61/125,897, filed on Apr. 29, 2008.

(51) Int. Cl.
*E21B 7/20* (2006.01)

(52) U.S. Cl. ..... 175/21; 175/67; 175/424; 405/248

(58) Field of Classification Search ..... 175/21, 175/67, 424; 405/228, 248
See application file for complete search history.

(56) References Cited

U.S. PATENT DOCUMENTS

| | | | | |
|---|---|---|---|---|
| 1,003,284 | A * | 9/1911 | Martin | 175/103 |
| 1,994,884 | A * | 3/1935 | Chew | 37/323 |
| 2,670,180 | A * | 2/1954 | Ranney | 175/21 |
| 4,657,441 | A | 4/1987 | Horvath | |
| 4,787,465 | A * | 11/1988 | Dickinson et al. | 175/67 |
| 6,263,984 | B1 * | 7/2001 | Buckman, Sr. | 175/67 |
| 6,516,902 | B1 * | 2/2003 | Klemm | 175/296 |
| 6,568,881 | B2 * | 5/2003 | Long | 405/248 |
| 6,675,919 | B2 | 1/2004 | Mosing et al. | |
| 7,090,153 | B2 * | 8/2006 | King et al. | 239/553 |

* cited by examiner

*Primary Examiner* — Kenneth L Thompson
(74) *Attorney, Agent, or Firm* — Onebane Law Firm; Greg R. Mier

(57) ABSTRACT

A drive shoe assembly used in helping penetrate earthen formations.

4 Claims, 3 Drawing Sheets

HYDRATING DRIVE SHOE

FIELD OF THE INVENTION

The present invention relates to a drive shoe assembly used in helping penetrate earthen formations, especially subsea soils as encountered in offshore wells.

BACKGROUND

It is known in the drilling of wells for hydrocarbons and other fluids to drive tubulars into an earthen formation, especially offshore into the seabed. In current practice, tubulars, which include conductor pipe, are driven by a pile driving apparatus, such as a pile driving hammer, from a point below a drilling rig floor to form a continuous string to a point in the earthen formation anywhere to a desired depth. This continuous string serves as conduit for the drilling activity and ensures that the upper portion of the well does not collapse. The string also serves as a conduit for fluids that are pumped down the well, as well as a support for subsequent casing strings or top side structure components.

"Drive shoes" refer to the bottom end of a string of conductor that is driven into the ground. In most cases, a drive shoe is merely an inverted bevel in the bottom end of the drive pipe. The inverted bevel helps to deflect the soil and reduce the end bearing when driving with a pile driving hammer. Other drive shoes are designed to push the soil or break up the soil formation. These drive shoes open a hole for the pipe, but the hole can cave in around the pipe due to soil pressure. When the hole caves in around the pipe, the friction between the soil and surface of the pipe make it difficult to drive the pipe deeper into the ground.

U.S. Pat. No. 4,657,441 (the '441 patent) teaches that soil is compressed and that such compression of the soil is unacceptable when using a drive shoe. The soil is compressed because, as the pipe is driven, both the soil at the inner diameter (ID) of the drive shoe and the soil at the outer (OD) of the shoe are compressed. The '441 patent also teaches breading up of the soil by having a series of ribs and a series of spiral inner bar sections on the OD to torsionally disassociate the soil, intermittently de-cohering the soil causing it to break up and become loose.

SUMMARY OF THE INVENTION

A drive shoe assembly for driving tubulars into an earthen formation, comprising a drive pipe having an inner surface, an outer surface, a top end, and a bottom end; a pile point secured to said inner surface of said drive pipe and extending from said bottom end of said drive pipe; a means for securing said pile point to said inner surface of said drive pipe; and hydration fluid channels through said pile point to said outer surface of said drive pipe.

Some of benefits of the present invention include deeper driving penetration of tubulars, faster driving time, less stress on the tubular, a clean well bore to the dept of the drive shoe immediately after the tubular is driven, larger well bore capabilities for deeper wells, and no mechanical parts.

BRIEF DESCRIPTION OF THE DRAWINGS

The accompanying drawings are provided for the purpose of illustration only and are not intended as a definition of the limits of the present invention. The drawings illustrate a preferred embodiment of the present invention, wherein.

DESCRIPTION OF THE INVENTION

While the present invention will be described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof) falling within the scope of the appended claims.

Figure 1:
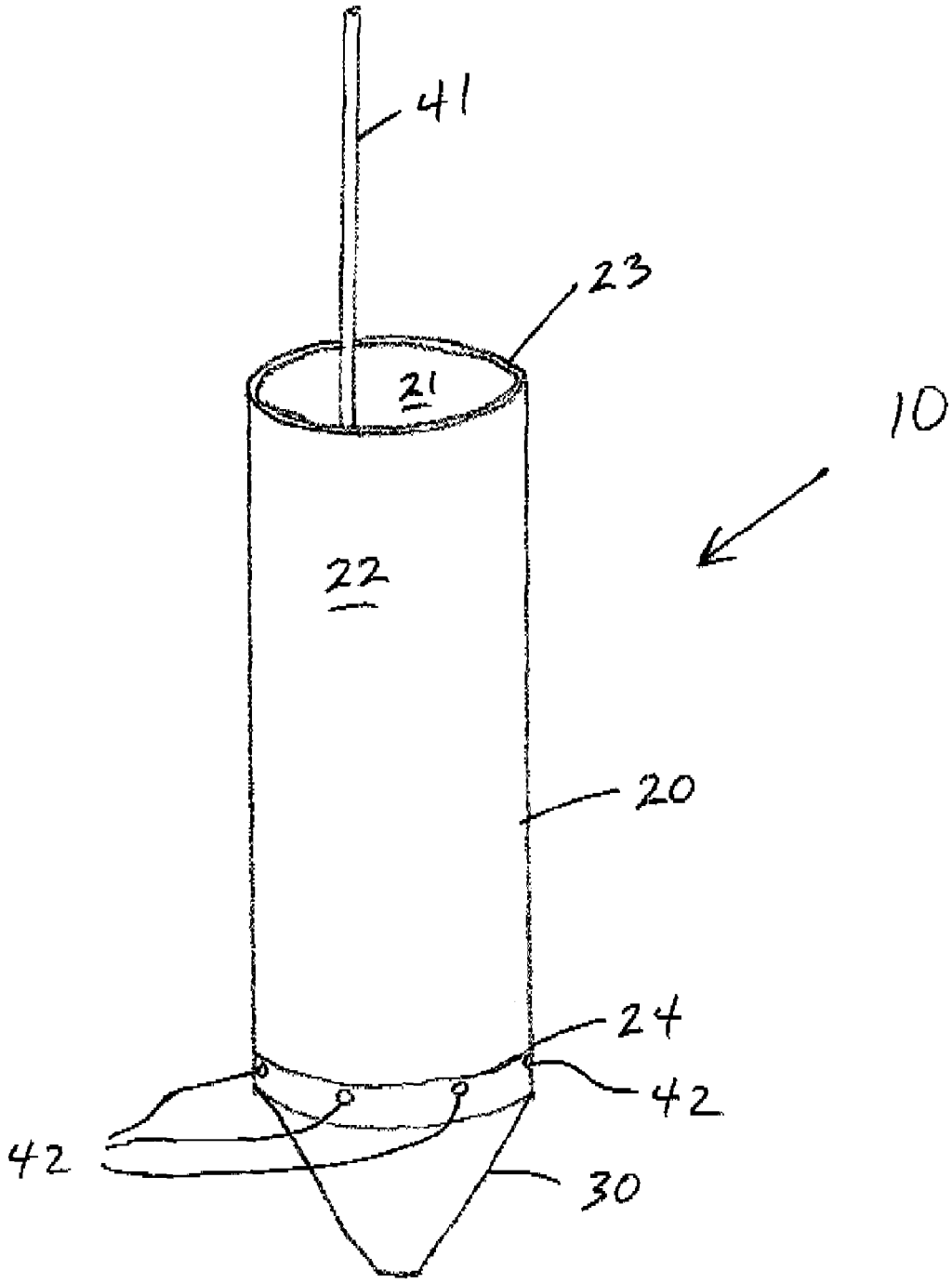
FIG. 1 shows an embodiment of the present invention.

Referring to FIG. 1, the drive shoe assembly 10 of the present invention includes a drive pipe 20, a pile point 30, and hydration fluid channels 40.

Figure 2:
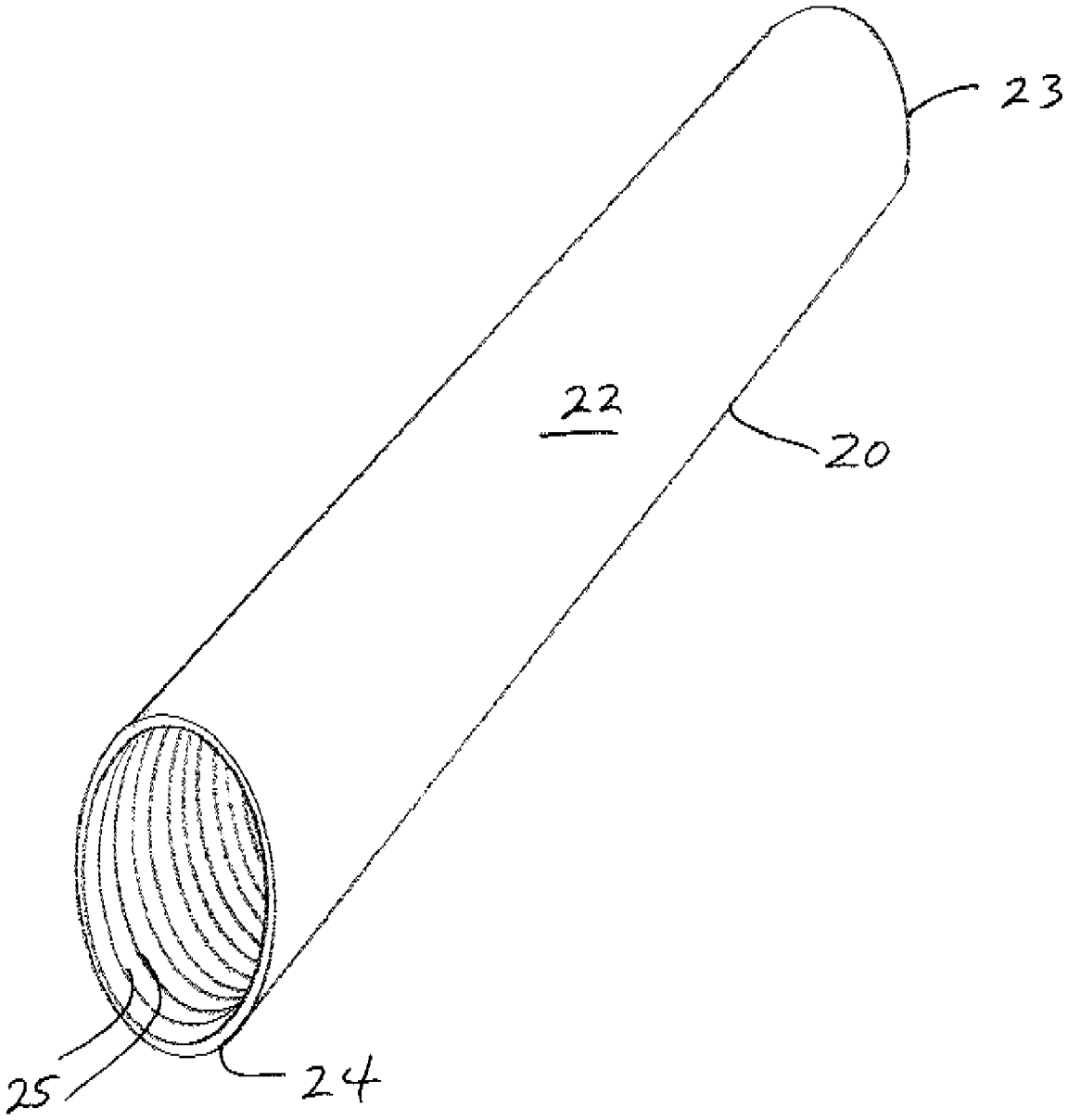
FIG. 2 shows an embodiment of the drive pipe of the present invention.

Referring to FIG. 2, drive pipe 20 can be constructed of standard steel pipe and can be any diameter suitable for attaching to the end of a drive string used for penetrating earthen formations. Drive pipe 20 has an inner surface 21, an outer surface 22, a top end 23, and a bottom end 24. In the preferred embodiment, drive pipe 20 is equipped with means for securing pile point 30 within the bottom portion of drive pipe 20. Said means can include, but is not limited to, a plurality of weld beads 25 around the circumference of inner surface 21. Said means can also include, but is not limited to, a plurality of grooves around the circumference of inner surface 21.

Figure 3:
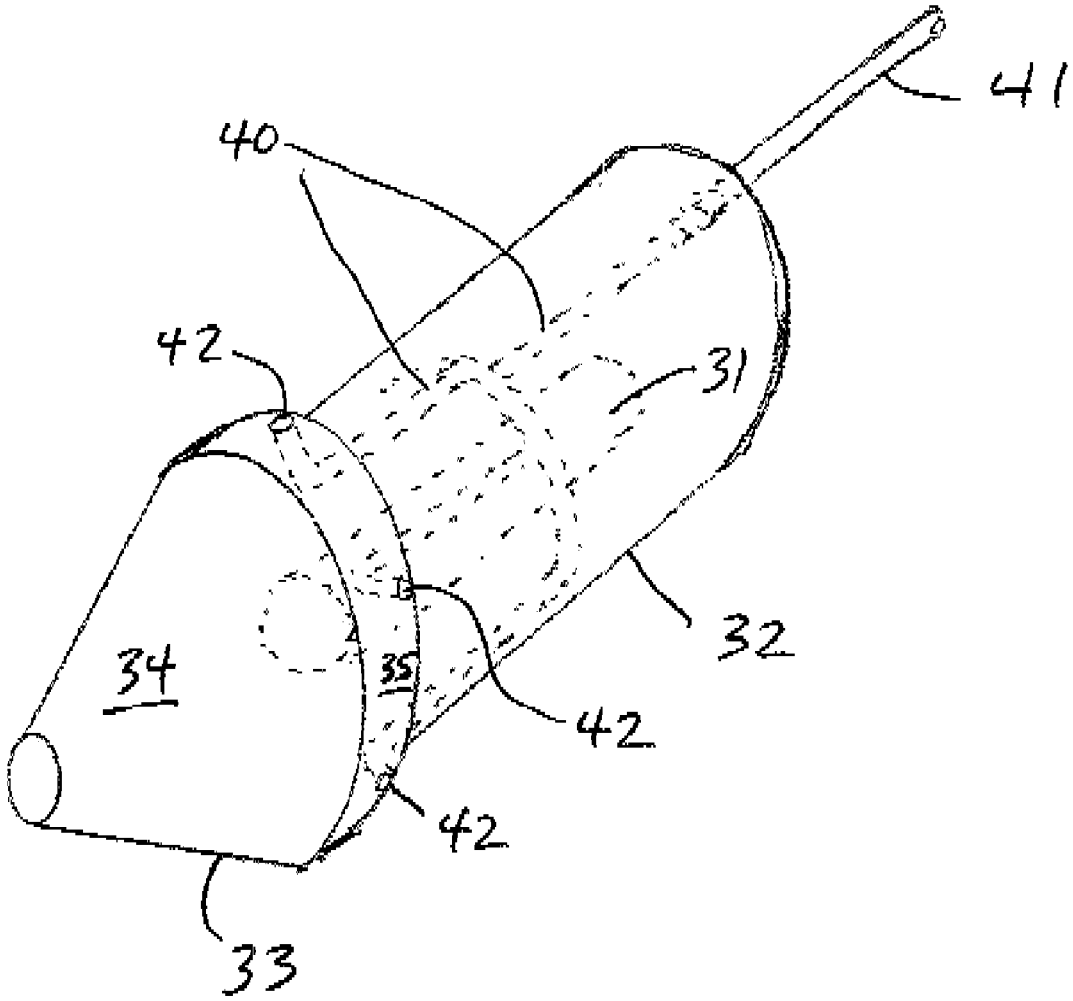
FIG. 3 shows an embodiment of the pile point and hydration fluid channels of the present invention.

Referring to FIG. 3, pile point 30 is designed to extend from within drive pipe 20 and beyond bottom end 24 of drive pipe 20. Pile point 30 is preferably constructed of cement, but can be constructed of any drillable material, such as, for example, plastic and aluminum. Pile point 30 preferably has two sections. The first section 32 has the shape of a cylinder, with an outer diameter that fits securely within the inner surface 21 of the lower portion of drive pipe 20. The second section 33 has the shape of a cone 34 having a shoulder 35.

Pile point 30 can be equipped with an orientation tube 31, that preferably extends concentrically through the first section 32 of pile point 30.

Pile point 30 is preferably equipped with hydration fluid channels 40, which allow the flow of fluids from above the top end 23 of drive pipe 20 and through pile point 30 to provide hydration and lubrication during penetration of the earthen formation. Hydration fluid channels 40 are typically, but not necessarily, constructed of PVC pipe. Hydration fluid channels 40 preferably include one or more inlets near the top end 23 of drive pipe 20, and multiple hydration ports 42 around the shoulder 35 of second section 33 of pile point 30. Hydration fluid channels 40 is preferably equipped with one or more detachable couplings for attaching a fluid source 41 to hydration fluid channels 40.

The drive shoe assembly 10 of the present invention is preferably constructed by first obtaining a section of drive pipe 20. Next, if desired, the inner surface 21 of drive pipe 20 is prepared for securing pile point 30 by placing weld beads 25 around the circumference of inner surface 21 near the bottom end 24 of drive pipe 20. Next, hydration fluid channels 40 and orientation tube 31, with both ends capped, are arranged within drive pipe 20. Next, a conical mold for forming pile point 30 is secured to bottom end 24 of drive pipe 20. Next, drive pipe 20 is put in a vertical position and cement is poured into drive pipe 20 to a height flush with the top of orientation tube 31 and allowed to cure, after which the conical mold is removed.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

What is claimed is:

1. A drive shoe assembly for driving tubulars into an earthen formation, comprising:

(a) a drive pipe having an inner surface, an outer surface, and a bottom end;

(b) a pile point extending from within said bottom end of said drive pipe and secured within said drive pipe, said pile point having a cylindrical section secured within said drive pipe and a conical section extending from said bottom end of said drive pipe, where said conical section has a shoulder;

(c) at least one well bead around said inner surface of said drive pipe near said bottom end of said drive pipe for securing said pile point within said drive pipe; and (d) a plurality of hydration fluid channels through said cylindrical section of said pile point which lead to a plurality of hydration ports around said shoulder of said conical section of said pile point.

2. The drive shoe assembly of claim 1 wherein said pile point is constructed of a moldable material.

3. The drive shoe assembly of claim 2 wherein said moldable material is cement.

4. The drive shoe assembly of claim 1 further comprising an orientation tube within said cylindrical section of said pile point.

* * * * *